United States Patent [19]

Mauthe et al.

[11] Patent Number: 4,858,759

[45] Date of Patent: Aug. 22, 1989

[54] CONTAINER ARRANGEMENT FOR CARTRIDGE DISPENSING TWO-COMPONENT MASS

[75] Inventors: Peter Mauthe, Kleinberghofen; Gabriele Grundmann, Munich; Monika Moench, Neuried, all of Fed. Rep. of Germany

[73] Assignee: Hilti Aktiengesellschaft, Fed. Rep. of Germany

[21] Appl. No.: 196,868

[22] Filed: May 20, 1988

Related U.S. Application Data

[62] Division of Ser. No. 944,747, Dec. 22, 1986, abandoned.

[30] Foreign Application Priority Data

Dec. 21, 1985 [DE] Fed. Rep. of Germany ..... 3545614

[51] Int. Cl.[4] ..... B65D 25/08

[52] U.S. Cl. ..... 206/221; 206/219; 206/220; 206/222

[58] Field of Search ..... 206/219, 220, 221, 222; 222/207, 386, 386.5; 604/202, 233, 232, 229, 207

[56] References Cited

U.S. PATENT DOCUMENTS

| | | | |
|---|---|---|---|
| 1,960,858 | 5/1934 | Strauch | 206/221 |
| 2,528,530 | 11/1950 | Machleder | 206/222 |
| 2,700,461 | 1/1955 | Smith | 206/219 X |
| 2,773,591 | 12/1956 | Jensen | 206/221 |
| 2,908,540 | 4/1961 | Turpin | 206/221 X |
| 3,330,281 | 7/1967 | Viser | 206/221 |
| 3,337,039 | 8/1967 | Knittel et al. | 206/221 |
| 3,521,745 | 7/1970 | Schwartzman | 206/222 |
| 3,802,604 | 4/1974 | Morane et al. | 206/222 X |
| 3,885,710 | 5/1975 | Cohen | 206/221 |
| 3,917,063 | 11/1975 | Chibret et al. | 206/221 |
| 4,247,001 | 1/1981 | Wiegner | 206/222 |
| 4,479,578 | 10/1984 | Brignola et al. | 200/221 |
| 4,693,366 | 9/1987 | Goncalves | 206/222 |

FOREIGN PATENT DOCUMENTS

| | | | |
|---|---|---|---|
| 64037 | 11/1951 | France | 206/221 |
| 1545963 | 10/1968 | France | 206/222 |
| 2453793 | 12/1980 | France | 206/222 |
| 2506726 | 12/1982 | France | 206/222 |

*Primary Examiner*—David T. Fidei
*Attorney, Agent, or Firm*—Toren, McGeady & Associates

[57] ABSTRACT

A cartridge for dispensing a two-component mass is formed by two interconnected containers to that different combinations of the components are provided along with different mixture ratios. Initially, the containers are separate with partitions located in their interconnecting regions. The partitions can be removed either before or after the containers are connected together. After removal of the partitions, the components of the mass can be mixed. Following the mixing operation, a piston within the cartridge can press out or dispense the mass through an outlet nozzle formed on one of the containers.

1 Claim, 4 Drawing Sheets

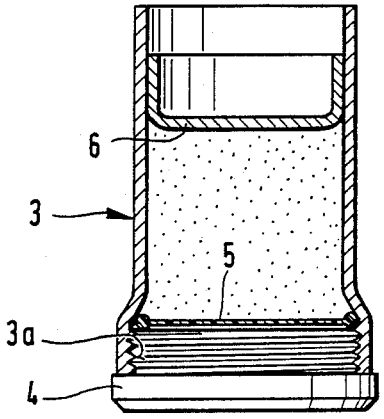
Fig. 2
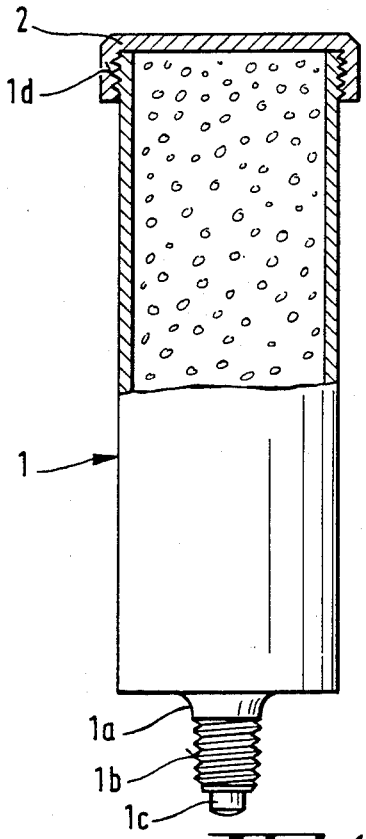
Fig. 1
Fig. 3
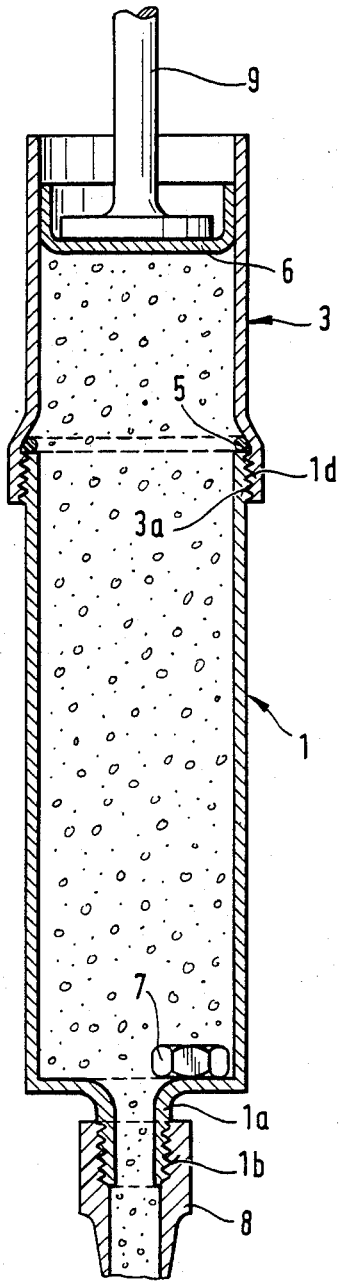

CONTAINER ARRANGEMENT FOR CARTRIDGE DISPENSING TWO-COMPONENT MASS

This is a division of application Ser. No. 944,747, filed Dec. 22, 1986, now abandoned.

BACKGROUND INVENTION

The present invention is directed to a cartridge for dispensing a two-component mass.

Two-component masses are used mainly in the construction field for fastening and sealing requirements as well as for the rehabilitation of cracked structures. Depending on their intended use, the masses have a more or less high viscosity as well as a shorter or longer reaction time. Since the reaction time is dependent largely upon the ambient temperature, different masses are required for different temperature ranges. Such a requirement is very cumbersome for a user, since different cartridges must be stored for the intended use depending, for instance, on the temperature range existing during different seasons of the year.

In known cartridges, the components making up the mass are provided in a common container separated by a destructible partition. If the partition is damaged during transport because of improper handling, the components can mix with one another and react. As a result, the cartridge becomes useless. Further, if considerable temperature increases or volume increases are initiated by the reaction, adjacent cartridges can also become damaged.

In another known cartridge system, one component is supplied from a collapsible tube into the cartridge and the contents are subsequently mixed. This system has the disadvantage that it can not be recognized from the outside of the cartridge whether the two components have been mixed together.

SUMMARY OF THE INVENTION

Therefore, the primary object of the present invention is to provide a cartridge which, depending upon the application and temperature range involved, enables different compositions and mixture conditions of the mass without any additional effort required in the production of the components in the dispensing of the mass.

In accordance with the present invention, the components of the mass are arranged in different containers which can be connected to one another, with the containers having removable partitions in their connection regions.

With the components located in separate containers which can be connected together, premature contact of the components within the containers is avoided. It is possible, in accordance with the invention, to combine specific resins with different types and amounts of hardener. Accordingly, the containers for the resin can be produced in considerably higher numbers and more economically. The partitions in the connecting regions are removed only immediately before or following the interconnection of the containers.

Two-component masses can exhibit very different viscosities, depending on temperature and use. For instance, highly fluid, that is, low viscosity, masses are used for injection into cracks, so that even the thinnest hairline cracks can be filled. To prevent run out of the components when the containers are interconnected, one removable partition is detachable and the other is destructible. Preferably, the detachable partition is removed prior to interconnecting the containers and the other partition is destroyed only after the containers are connected together. It is preferred that the destructible partition is arranged in the container whose opening points toward the bottom during the interconnection of the containers.

Since the detachable partition is exposed during transportion and handling to mechanical stresses, it is advantageous that it is in the form of a mechanically removable sealing cap. Such a cap can be detachably connected with the container by a threaded connection or a bayonet lock. In certain circumstances, a simple plug retained in place by a press fit would be adequate as the sealing member.

Another appropriate embodiment is in the form of a removable partition designed as an axially displaceable piston. The piston may also be in the form of a cup-shaped sealing disc. If the piston is displaced counter to its pressing direction, the sealing lips on the piston are displaced radially inwardly and the component secured by the piston can flow around it. On the other hand, if the piston is moved in the pressing direction, the sealing lips are pressed by the mass radially outwardly against the container wall affording a sealing action. Preferably, the destructible partition is in the form of a diaphragm. Accordingly, the components within the containers can be mixed together after the connecting operation. This mixing procedure is not impaired, if as complete a destruction as possible takes place. A diaphragm has a very small wall thickness in comparison to its surface area and can be formed of a plastics material Further, the diaphragm may be an elastic member. Advantageously, the diaphragm of the container holding one of the components can be chemically dissolved by the component in the other container. As a result, the diaphragm is automatically destroyed after the containers are interconnected.

Another appropriate embodiment is that one container has a puncturing projection which can extend into the other container for breaking or destroying the diaphragm in the other container. In such an arrangement, the destruction of the diaphragm takes place automatically when the containers are interconnected. During its destruction, the diaphragm can be provided with incisions or portions of the diaphragm or the whole diaphragm can cut out or stamped out.

After interconnecting the containers, the components now in the cartridge formed by the containers require an additional mixing process. It is advantageous, after the containers are connected together and the partitions have been removed, if the mixing of the components within the cartridge occurs in a mixing device. The entire cartridge can be shaken or rotated about an axis with a mixing member located in the cartridge effecting a swirling or centrifugal action facilitating the mixing. In a simple construction of the mixing device, it is preferred if a rotating magnetic field is generated in the mixing device for effecting the movement of the mixing member within the cartridge. During the mixing operation, the cartridge does not move. Therefore, the power requirement for the mixing device is very small. Usually it is difficult to determine from the exterior of the cartridge whether the mixing process has been completed. If inadequate mixing takes place, the mass dispensed from the cartridge does not have the desired properties. To assure adequate mixing, it is advantageous if the cartridge is sealed in the connecting regions of the containers while the mixing operation is carried out. The sealing operation, on one hand, serves to join the containers in the connecting region and, on the other hand, possible protrusions on the cartridge can be melted and reformed by the sealing operation and permit insertion of the cartridge into the dispensing device.

Further, the sealing of the containers can afford a visual indication that the mixing operation performed at the same time has been completed.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawings:

FIG. 1 is an elevational view of a container holding one component of a two-component mass, shown partly in section, with the container in condition to be transported or stored;

FIG. 2 is an elevational view, partly in section, of a container for the second component of a two-component mass in the same condition as the container in FIG. 1;

FIG. 3 is an elevational sectional view of a cartridge formed by the containers in FIGS. 1 and 2 with the mass ready to be dispensed;

DETAILED DESCRIPTION OF THE INVENTION

Figure 5:
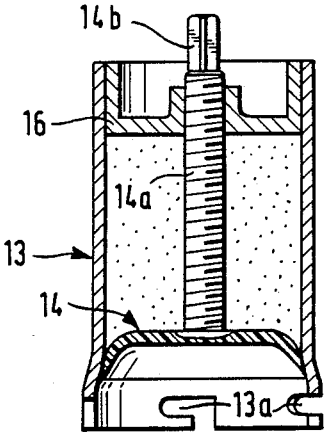
FIG. 5 is a view similar to FIG. 2 showing another container embodying the present invention and in the same condition as the container in FIG. 4.

In FIG. 1 a cylindrically shaped axially extending container 1 is shown holding one component of a two-component mass. At its front end, the lower end in FIG. 1, the container has an outlet nozzle 1*a* with a thread 1*b* formed on its outside surface and a removable stud 1*c* closing the outlet nozzle. At its rear end, the upper end in FIG. 1, the container has an external thread 1*d* with a sealing cap 2 threaded on and closing the rear end.

In FIG. 2 a second cylindrically shaped axially extending container 3 is illustrated. At its lower or front end, the container 3 has an inside thread 3*a* and a sealing plug 4 is threaded into the inside thread. Spaced inwardly from its front end, the container 3 has a diaphragm 5 supported on a shoulder defined by the inner portion of the container at the inner end of the inside thread 3*a*. At its rear end, the container 3 is closed by an axially displaceable piston 6 for pressing the two-component mass out of the cartridge. As shown in FIG. 2, the piston 6 is recessed inwardly from the rear end of the container 3 so that varying amounts of the component can be held within the container between the diaphragm 5 and the piston 6.

To utilize the cartridge shown assembled in FIG. 3, the containers 1 and 3 are interconnected after the sealing cap 2 is removed from the container 1 and the sealing plug 4 is removed from the container 3. The connection of the two containers is effected by engagement of the thread 1*d* in the internal thread 3*a* in the container 3. Diaphragm 5 is chemically resistant to the component held in the container 3. Upon contact with the component within the container 1, however, the diaphragm 5 is chemically dissolved. As a result, the partition separating the contents of the containers 1 and 3 is automatically destroyed when the containers are connected together. As can be seen in FIG. 3, a nut 7 is located within the container 1 and serves as a mixing member. By shaking the assembled cartridge, the components are mixed with one another. Another possible arrangement is to insert the cartridge in a so-called magnetic mixer, described with relation to FIG. 10, where the mixer generates a moving magnetic field so that the nut 7 is swirled or moved around within the containers 1 and 3 effecting the mixing action.

After removing the stud 1*c* from the outlet nozzle 1*a*, a dispensing nozzle can be threaded on to the thread 1*b* on the outlet nozzle. Subsequently, the mixed two-component mass within the cartridge can be dispensed by pressing the piston 6 from the rear end toward the front end of the cartridge by a pressure ram 9, note FIG. 3.

Figure 4:
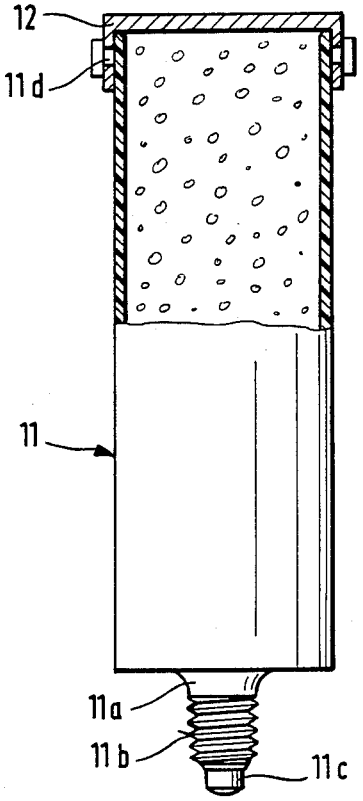
FIG. 4 is a view similar to FIG. 1, of another embodiment of the present invention illustrating a container holding one component of a two-component mass and in condition for transportation or storage.

In FIG. 4 a cylindrically shaped axially extending container 11 is displayed with an outlet nozzle 11*a* at its lower or front end with a thread 11*b* on the outside of the nozzle and with a stud 11*c* inserted into the nozzle. The rear end of the container 11 located around the circumferentially extending outside surface of the container is provided with cam catches 11*d*. A sealing cap 12 is detachably secured on the rear end of the container 11 by means of the cam catches 11*d*.

In FIG. 5 a cylindrically shaped axially extending container 13 is set forth and the lower or front end of the container is provided with slots 13*a* in the front end region of the container which has a widened diameter as compared to the remainder of the container. The diameter of the front end region is increased by the wall thickness of the container. The slots 13*a* are shaped to interengage with the cam catches 11*d* on the container 11 and form a bayonet lock. A piston 14 is located within the container 13 adjacent but spaced from its front end. The piston is displaceable in the axial direction of the container 13. Piston 14 is designed as a cup-shaped sealing disc with a deformable sealing lip encircling the radially outer edge of the disc. A threaded spindle 14*a* is located within the container 13 and is connected with the piston 14. The rear or upper end of the spindle 14*a* has a polygonal shape 14*b* for rotating the spindle and in turn the piston 14. Another piston 16 is located within the rear end of the container 13 and the spindle 14*a* is in threaded engagement with the piston 16. The second component of the mass is located within the container 13 between the two pistons 14, 16.

After removing the sealing cap on the rear end of the container 11 the two containers 11, 13 can be interconnected by the bayonet lock formed by the cam catches 11*d* and the slots 13*a*. Subsequently, the piston 14 is moved within the container 13 toward the piston 16 by rotating the threaded spindle 14*a* relative to the dispensing piston 16. As a result, the sealing lip encircling the piston 14 is displaced from contact with the inside surface of the container 13 and the second component can flow around the piston 14 in contact with the component within the container 11. As a result, the components of the containers 11, 13 contact each other.

Figure 6:
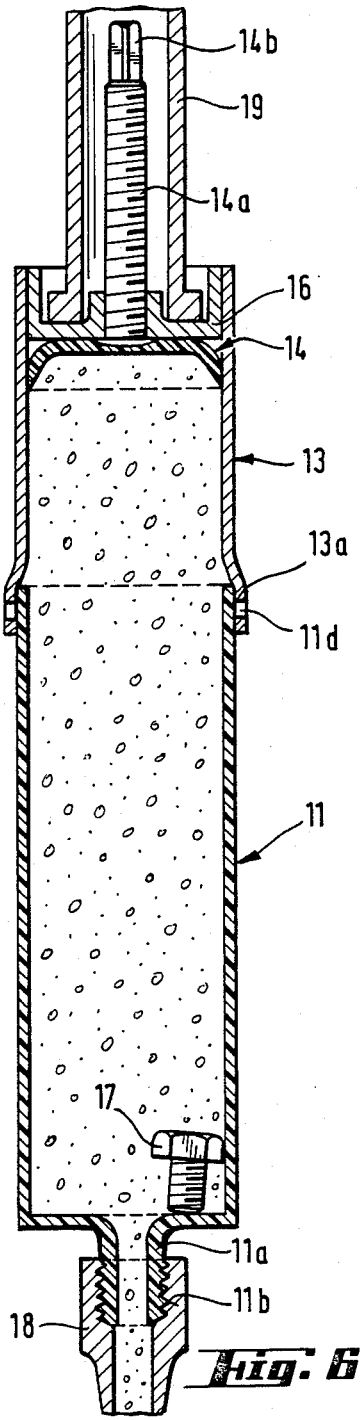
FIG. 6 is a view similar to FIG. 1 displaying a cartridge embodying the present invention and made up of the containers illustrated in FIGS. 4 and 5 with the cartridge in the dispensing condition.

In FIG. 6 the piston 14 has been retracted into contact with the piston 16 so that virtually all of the component within the container 13 has been displaced forwardly of the piston 14. The components can then be mixed together by a mixing member in the form of a bolt 17 located within the container 11. If the mixing operation takes place in a mixing device, the cam catches 11*d* can be melted so that they no longer project outwardly beyond the front end of the container 13 and completely fill the slots 13*a*. The melting of the cam catches 11*d* effects a welding action between the two containers. As a result, the containers 11, 13 can not be separated from one another. This procedure can also be designated as sealing. By the appropriate design of the dispensing device for use with the cartridge shown in FIG. 3, the insertion of the cartridge can be effected only after the cam catches 11*d* have been melted down. The dispensing of the mass in the cartridge is effected by placing a hollow pressure ram 19, note FIG. 6, against the piston 16. After the stud 11*c* is removed from the front end of the container 11 and a dispensing nozzle 18 is secured on to the thread 11*b* of the outlet nozzle 11*a*, the pressure ram 19 moving the pistons 16 and 14 can effect the dispensing of the mixed mass of components.

The embodiment as shown in FIGS. 4–6 permits the mixing of different ratios of the components in the same containers 11, 13 by withdrawing the piston 14 towards the piston 16 for a selected axial distance whereby a smaller or larger amount of the second component within the container 13 is pressed from between the two pistons 14, 16 toward the component located within the container 11.

Figure 7:
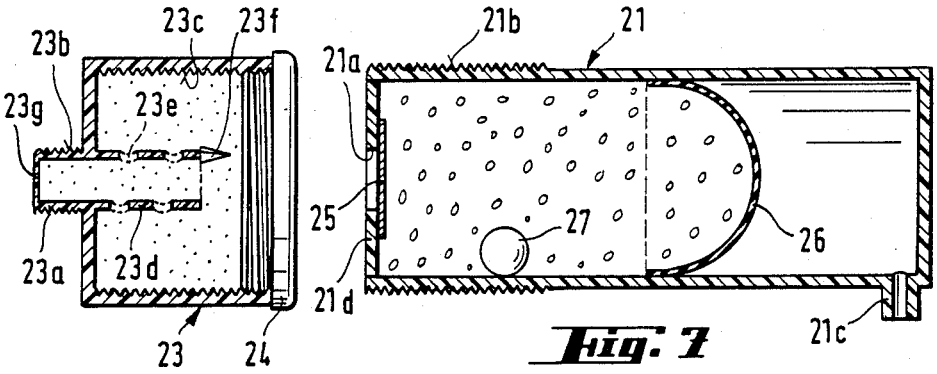
FIG. 7 is a cross-sectional view of still another embodiment of the present invention illustrating the two containers making up the cartridge in the condition for transportation or storage.
Figure 8:
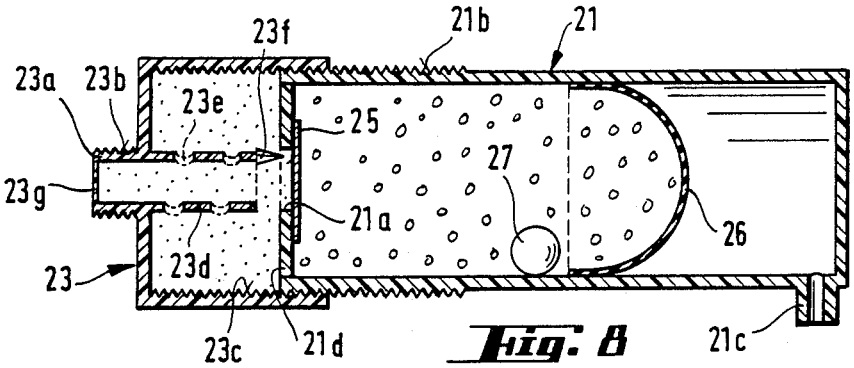
FIG. 8 is a view similar to FIG. 7 where the two containers making up the cartridge have been interconnected.
Figure 9:
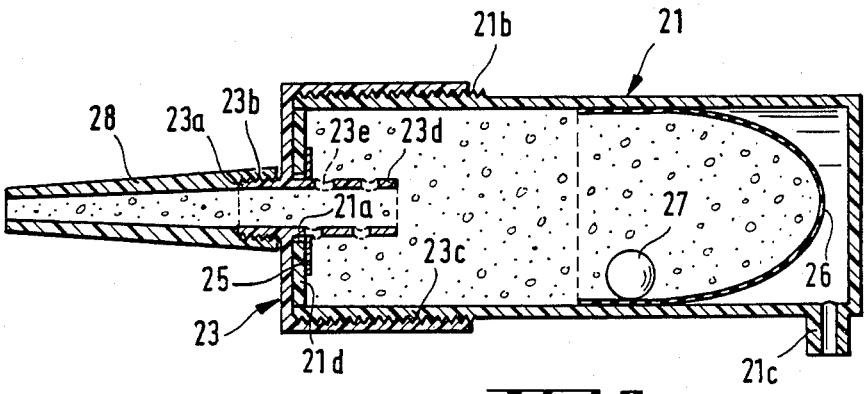
FIG. 9 is a view similar to FIG. 8, however, showing the components of the mass in the mixed condition and ready to be dispensed.

In FIGS. 7–9 another embodiment of the present invention is displayed where the cartridge is formed by two cylindrically shaped axially extending containers 21, 23. In FIG. 7 the containers are shown separated from one another, while in FIG. 8 the containers are interconnected.

Container 21 has an outlet aperture 21*a* at its front end, that is, the left-hand end as viewed in FIGS. 7–9. The container 21 has an external thread 21*b* in its front end region and it has a nipple 21*c* extending from its circumferential surface adjacent the rear end. The outlet aperture 21*a* is located in a cover disc 21*d* which is connected to the front end of the container after the container has been filled. The connection between the container 21 and the cover disc 21*d* can be made by welding or bonding. Container 23 has a closed end tubular projection 23*a* extending axially outwardly from the front end of the container. The outside circumferential surface of the projection 23*a* has a thread 23*b*. In addition, the inside end of the container 23 has an inside thread 23*c* arranged to receive the external thread 21*b* on the front end region of the container 21. Within the container 23, the projection 23*a* is extended by an open-ended stub 23*d* extending from the rear end of the container toward but spaced from the leading end thereof. The stub 23*d* has passage apertures 23*e* in its circumferential surface. In addition, a puncturing projection 23*f* extends from the rear end of the stub 23*d* toward the rear end of the container 23.

During transport and storage, the container 23, as shown in FIG. 7, is sealed at its rear end by a sealing plug 24 screwed into the inside thread 23*c*. Outlet aperture 21*a* in the container 21 is sealed by destructable diaphragm 25 extending across the aperture on the inside of the container. Each of the containers 21, 23 holds a separate one of the components of a two-component mass. For combining the two components of the mass, the containers 21, 23 are interconnected by the external thread 21*b* on the container 21 interengaged with the internal thread 23*c* on the container 23 after the sealing plug 24 has been removed. This condition of the cartridge is set forth in FIG. 8. As shown in FIG. 8, the two components are still separated from one another by the diaphragm 25. If the front container 23 is screwed on to the thread 21*b* on the container 21 for the full axial length of the front container the diaphragm 25 is destroyed by the puncturing projection 23*f* and subsequently the projection 23*f* is broken off. With the diaphragm 25 ruptured, the components within the container 23 can flow into the front end of the container 21 passing through the apertures 23*e* and the interior of the stub 23*d*. An elastic bladder 26 is secured within the container 21 and is stretched, as can be seen in FIG. 9, when the contents of the container 23 are displaced into the container 21.

In FIG. 9 the final condition of the cartridge is displayed after the component in the container 23 has been completely pressed into the container 21. Subsequently, by shaking the cartridge, the components are mixed with one another due to the movement of a ball 27 which serves as a mixing member and is located within the container 21. A cover 23*g* closes off the outside end of the tubular section 23*a*. After destroying the cover 23*g*, which seals the tubular section 23*a* and the stub 23*d*, a dispensing nozzle 28 can be screwed on to the tubular section 23*a* on the outside of the cartridge. The mass within the cartridge is pressed out by a pressure medium, such as compressed air or carbon dioxide, introduced into the container 21 through the nipple 21*c* so that it acts on the bladder and presses the mixed contents of the cartridge toward the dispensing nozzle 28. Accordingly, almost all of the mass located within the cartridge can be pressed out through the stub 23*d* and the tubular section 23*a* except for a small residual amount.

Figure 10:
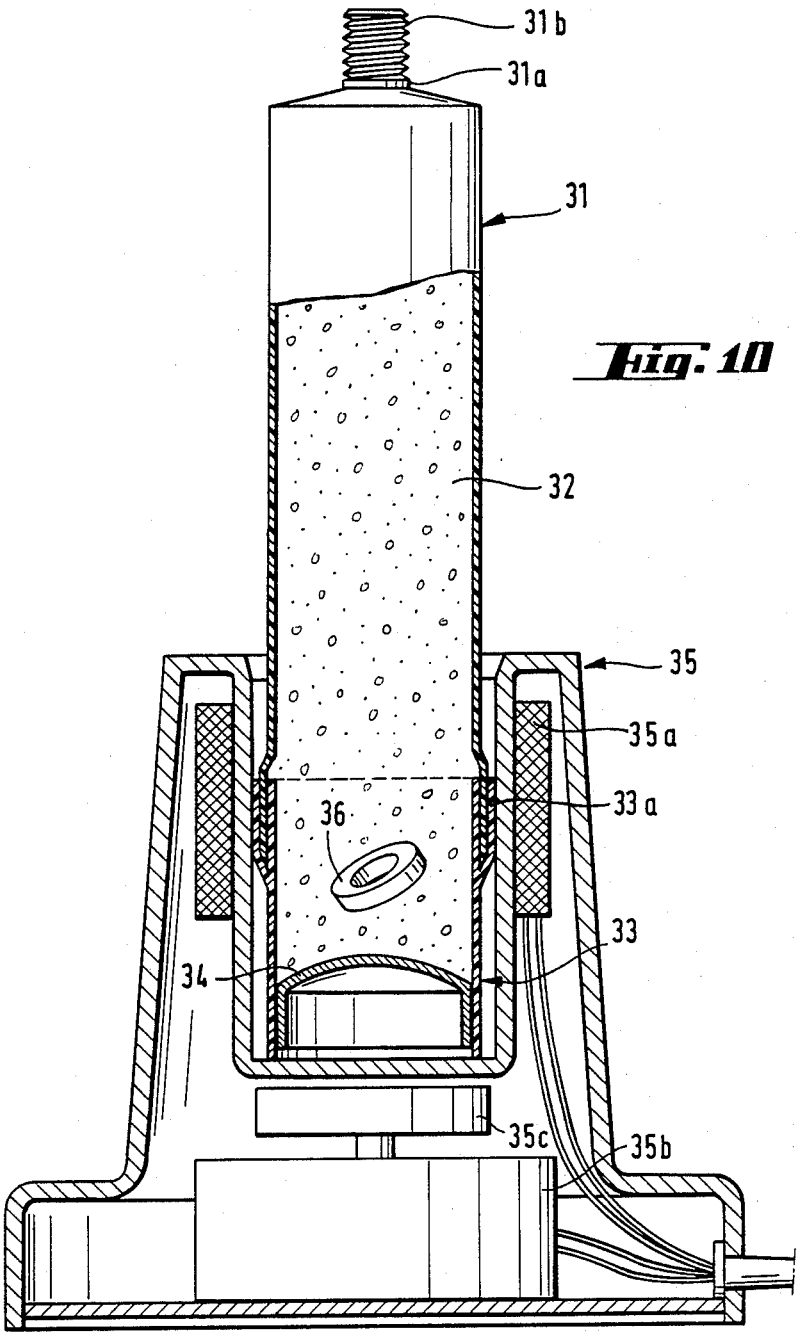
FIG. 10 is an elevational view, mainly in section, illustrating a mixing device for mixing the components in a cartridge embodying the present invention and formed of two containers.

In FIG. 10 another cartridge embodying the present invention is shown in the assembled condition and is constituted by an upper container 31 and a lower container 33 as viewed in FIG. 10. The components of the mass contained within the containers are arranged to be mixed together. Container 31 has an axially extending projection or nozzle 31*a* equipped with an outer thread 31b for receiving a dispensing nozzle, not shown. Container 33 is a tubular shaped member and in the connecting region with the container 31 has a circular elastic tang 33*a* located radially outwardly from the enlarged rear end of the container 31. Upon the introduction of the cartridge in FIG. 10 into a mixing deviced 35, the tang 33*a* is pressed radially inwardly against the outside surface of the rear end of the container 31 and, subsequently, can be welded to the container 31 by a heating coil 35*a* located within the mixing device. The welding action provides a seal in the connecting region between the two containers 31, 33. A magnet 35*c* rotatable by a motor 35*b* arranged within the base of the mixing device 35 generates a rotating magnetic field when the motor 35*b* is turned on. A mixing member 36 formed of a ferro-magnetic material is moved or swirled around within the mass by the rotating magnetic field so that the components within the two containers 31, 33 are mixed together. After the removal of the cartridge from the mixing device 35, the completion of the mixing operation can be noted by the welding of the tang 33*a* to the container 31, which welding occurs at the same time that the mixing is being effected..

While specific embodiments of the invention have been shown and described in detail to illustrate the application of the inventive principles, it will be understood that the invention may be embodied otherwise without departing from such principles.

We claim:

1. Cartridge for a two-component mass comprises a first axially extending container holding one component of the mass and a second axially extending container holding the other component of the mass, said first and second containers each having a first end and a second end and being connectable together at the first ends thereof in axial alignment, wherein the improvement comprises that each of said first and second containers has a connecting region at the first ends thereof where said containers are connectable together, each connecting region has a removable partition forming a sealed closure before said containers are connected together, so that upon removal of the partitions from the connecting region, the contents of the first and second containers can be intermixed, one of said removable partitions is a mechanically detachable sealing cap, the other said removable partition is an axially displaceable piston displaceable within and in the axial direction of the container in which it is positioned away from the other container, whereby the components of the mass can be intermixed, said container in which said piston is located has an inside surface, said displaceable piston is a cup-shaped sealing disc with an annular deformable sealing lip projecting from said sealing disc toward the first end of the container in which the piston is located and disposed in contact with the inside surface of said container so that as said piston is displaced in the direction toward the second end of said container in which it is positioned, said lip deflects whereby the component within the container can flow around said piston into the component in the other said container.

* * * * *